US008610642B2

(12) United States Patent
Winton

(10) Patent No.: US 8,610,642 B2
(45) Date of Patent: Dec. 17, 2013

(54) METHOD OF ALLOCATING ADVERTISING SPACE AND SYSTEM THERFOR

(75) Inventor: Andrew Winton, Sydney (AU)

(73) Assignee: Karen Pamela Winton, Darling Point (AT)

( * ) Notice: Subject to any disclaimer, the term of this patent is extended or adjusted under 35 U.S.C. 154(b) by 28 days.

(21) Appl. No.: 12/490,073

(22) Filed: Jun. 23, 2009

(65) Prior Publication Data

US 2009/0255192 A1 Oct. 15, 2009

Related U.S. Application Data

(60) Continuation of application No. 11/418,167, filed on May 4, 2006, now Pat. No. 7,549,254, which is a continuation-in-part of application No. 11/283,317, filed on Nov. 17, 2005, now abandoned, which is a division of application No. 10/314,116, filed on Dec. 6, 2002, now abandoned.

(30) Foreign Application Priority Data

Dec. 7, 2001 (AU) ..... 9361
Jan. 18, 2006 (AU) ..... 2006900262

(51) Int. Cl.
*G09G 5/00* (2006.01)

(52) U.S. Cl.
USPC ..... 345/1.3; 52/28; 52/38; 40/584; 345/1.1

(58) Field of Classification Search
USPC ..... 52/38, 28, 105, 222, 741.1; 40/217, 40/212, 584, 606.03; 345/1.3, 1.2, 1.1, 345/3.3; 705/14.4, 14.49, 14.62, 14.63
See application file for complete search history.

(56) References Cited

U.S. PATENT DOCUMENTS

| | | | |
|---|---|---|---|
| 1,796,233 | A | 3/1931 | Barns |
| 1,933,878 | A | 11/1933 | Stebbins |
| 3,089,268 | A | 5/1963 | Frey et al. |
| 3,102,365 | A | 9/1963 | Whitesell |
| 3,607,582 | A | 9/1971 | Horacek |
| 3,800,726 | A | 4/1974 | Murphy |
| 4,019,271 | A | 4/1977 | Latimer |
| 4,261,417 | A | 4/1981 | Tingley |

(Continued)

FOREIGN PATENT DOCUMENTS

| | | |
|---|---|---|
| AU | 734344 | 6/2001 |
| DE | 19926 655 A1 | 11/1999 |

(Continued)

OTHER PUBLICATIONS

European Search Report for corresponding application EP 1 324 296 A3, dated Oct. 27, 2004.

(Continued)

*Primary Examiner* — Alfred J Wujciak
(74) *Attorney, Agent, or Firm* — Knobbe, Martens, Olson & Bear, LLP

(57) ABSTRACT

A built structure having an upward facing surface having a first image positioned thereon. The first image is visible from craft passing overhead and revenue is derived from the image on the upward facing image. The image is an active image that is controlled by a local controller so that the image can be replaced by a fresh image from a remote computer that communicates with the local controller via the internet.

10 Claims, 15 Drawing Sheets

(56) References Cited

U.S. PATENT DOCUMENTS

| | | | | |
|---|---|---|---|---|
| 4,860,475 | A | 8/1989 | Levy et al. | |
| 5,280,270 | A | 1/1994 | Correa | |
| 5,359,796 | A | 11/1994 | Werling | |
| 5,529,433 | A | 6/1996 | Huynh et al. | |
| 5,612,741 | A | 3/1997 | Loban et al. | |
| 5,815,966 | A | 10/1998 | Vestevich | |
| 6,060,993 | A | 5/2000 | Cohen | |
| 6,205,719 | B1 | 3/2001 | Bruce | |
| 6,236,330 | B1 | 5/2001 | Cohen | |
| 6,299,934 | B1 | 10/2001 | Manning | |
| 6,414,602 | B2 | 7/2002 | Polyakov | |
| 6,701,143 | B1 | 3/2004 | Dukach et al. | |
| 6,850,209 | B2 | 2/2005 | Mankins et al. | |
| 7,549,245 | B2 | 6/2009 | Ter-Hovhannissian | |
| 7,549,254 | B2 * | 6/2009 | Winton | 52/38 |
| 2001/0018810 | A1 * | 9/2001 | Chafer | 40/584 |
| 2002/0054033 | A1 | 5/2002 | Nakamura et al. | |
| 2003/0136058 | A1 | 7/2003 | Winton | |
| 2006/0075695 | A1 | 4/2006 | Winton | |
| 2007/0011953 | A1 | 1/2007 | Winton | |
| 2009/0084045 | A1 | 4/2009 | Winton | |

FOREIGN PATENT DOCUMENTS

| | | |
|---|---|---|
| DE | 10021010 | 11/2001 |
| EP | 0 911 255 | 4/1999 |
| FR | 2 605 128 | 10/1986 |
| JP | 08194447 | 7/1996 |
| JP | 08254409 | 10/1996 |
| JP | 10-171390 | 6/1998 |
| WO | WO 96/38832 | 12/1996 |
| WO | WO 97/05595 | 2/1997 |

OTHER PUBLICATIONS

U.S. Appl. No. 12/329,446, filed Dec. 5, 2008, Winton, Andrew, Sep. 29, 2009 Office Action & Response.

U.S. Appl. No. 12/329,446, filed Dec. 5, 2008, Winton, Andrew, Sep. 29, 2009 Office Action & Response Jun. 9, 2010 Office Action.

* cited by examiner

METHOD OF ALLOCATING ADVERTISING SPACE AND SYSTEM THERFOR

RELATED APPLICATIONS

This application is a continuation of U.S. patent application Ser. No. 11/418,167 filed May 4, 2006, which is a continuation-in-part application of U.S. patent application Ser. No. 11/283,317, filed Nov. 17, 2005, which is a divisional application of U.S. patent application Ser. No. 10/314,116, filed Dec. 6, 2002, which claims priority to Australian Application No. PR9361, filed Dec. 7, 2001. This application also claims the benefit of priority to Australian Application No. 2006900262, filed Jan. 18, 2006. All related applications are hereby incorporated herein by reference in their entirety.

The invention relates to the commercialization and application of images on roof surfaces for the purpose of advertising products, services, corporate names or the like to viewers in over-flying craft or the like.

BACKGROUND OF THE INVENTION

In the competitive world of advertising there is a continual search for available space which may be used to bring a product, service or corporate name to the attention of the public. In many cases this drive to advertise has led to an overcrowding of signage in public places, often to the detriment of the environment and a devaluation of impact of an individual advertising image.

It is an object of the invention to address or ameliorate one or more of the abovementioned disadvantages or at least provide a useful alternative.

SUMMARY OF THE INVENTION

In this specification the term "craft" is to be interpreted broadly to include all forms of device for conveying persons above or over the top of built structures. In particular forms this will include aircraft.

Accordingly, in one broad form of the invention there is provided a built structure having an upward facing surface; said built structure supporting a first image and a second image; said upward facing surface overlaid by said first image in the form of first advertising indicia; said first image arranged for visibility from overflying craft; and wherein revenue is derived from said upward facing surface; and wherein said revenue is a function of a cone of legibility; said cone comprising an inverted conical section of a sphere whose generator is equal to the distance of resolution of the smallest discrete detail of said image; said second image in the form of a substantially vertically oriented sign having second advertising indicia thereon adapted for viewing from ground level and for which separate signage rights may be negotiated; said upwardly facing surface mechanically associated with both said first image and said second image.

Preferably said first image and said second image are supported on a support structure which, in turn, is supported on said upward facing surface.

Preferably said first image and said second image comprise an active image in communication with a local controller whereby each respective image can be replaced by loading a fresh image from a local controller.

Preferably said local controller is in communication with a remote computer; said remote computer adapted to communicate one or more of said first image and said second image to said local controller.

Preferably said first image and said second image are formed on or in a flexible planar material.

Preferably said flexible planar material comprises electronic digital paper.

Preferably said predetermined legibility distance is in the range 100-2000 feet.

Preferably said predetermined legibility distance is in the range 100-10000 feet.

Preferably said predetermined legibility distance is in the range 30,000-40,000 feet.

Preferably said built structure is a roof.

Preferably said built structure is a pontoon.

Preferably said revenue is derived by the steps of:

(a) procuring said upward facing surface and obtaining signage rights to said surface;

(b) offering to a third party said surface as a platform for said first and second advertising indicia for a predetermined period of time.

Preferably revenue is derived therefrom by the steps of procuring the application of said first advertising indicia to said surface in such manner as to be observable from craft passing over said surface at a predetermined legibility distance; wherein said predetermined legibility distance is defined by and lies within the volume of said cone of legibility.

Accordingly, in a further broad form of the invention there is provided a system for the application of an image to an upper surface of a built structure, said image arranged for visibility from over-flying craft.

Preferably said upper surface comprises a rooftop.

Preferably characteristics of said image define a cone of legibility.

Preferably said image is displayed for a predetermined time at a predetermined revenue rate.

Preferably said image is displayed for a time period in the range of 1 to 12 months.

Preferably said image is displayed for a time period in the range of 1 to 5 years.

Preferably said image is displayed for a time period in the range of 1 to 10 years.

Preferably said image is in the form of a company name or logo.

Preferably said image is displayed in the form of an advertisement for a product or service.

Preferably the step of commercialization includes leasing of space on said rooftops.

Preferably said space is made available on a commercial basis to third parties for the display of advertising indicia thereon.

Preferably said image is displayed in the form of textual or graphic information.

Preferably said image comprises a series of images displayed consecutively.

Preferably said image is a moving image.

Preferably said image is applied as a film.

Preferably said image is applied by way of projection onto said rooftops.

Preferably the subtended angle of said cone is determined according to a parameter based on roof surface texture and discontinuities of the roof surface.

Preferably the commercial value of an advertisement applied to said rooftops is a function of the cone of legibility.

Preferably commercial value of said image is a function of the number and characteristics of aircraft flight paths intersecting said cone.

Preferably each said image is applied as paint by an applicator adapted to traverse a roof surface.

Preferably each said image is formed from an array of coloured panels, segments, dots or pixels.

Preferably the panels, segments, dot or pixel size and spacing is determined according to information theory.

Preferably the resolution of each said image allows for roof discontinuities such as sky lights.

Preferably the resolution of each said image allows for roof discontinuities such as changes of roof angle.

Preferably each said image is provided with day and/or night time illumination.

Preferably said applicator is in modular form arranged to be lifted to a rooftop in sections for reassembly.

Preferably the applicator is provided with traversing means for progressively applying an image to a roof surface.

Preferably said applicator is provided with a rail system arranged to guide said applicator over an expanse of roof.

Preferably the applicator is provided with support wheels and propulsion means.

Preferably the applicator is provided with a plurality of paint, toner or ink dispensing nozzles disposed along an axis transverse to the direction of the guide rails of the applicator.

Preferably the applicator is provided with digital and/or mechanical control means.

Preferably the control means determines the sequence, colour, duration and the nozzle from which paint, toner or ink is dispensed.

Preferably the pixel panel, segment or dot size delivered by the nozzles may be varied according to the required resolution of the image to be applied.

In yet a further broad form of the invention there is provided a method of allocating advertising space, the method comprising the steps of:

(a) Procuring a roof surface and obtaining signage rights to the roof surface;

(b) Offering the roof surface as a platform for advertising indicia for a predetermined period of time;

(c) Procuring the application of the advertising indicia in such manner as to be observable from over flying aircraft.

In yet a further broad form of the invention there is provided an upper surface of a built structure incorporating indicia thereon or therein; said indicia constructed so as to be discernable by observers in craft passing over said built structure when said craft is within a predetermined legibility distance of said built structure.

Preferably said predetermined legibility distance is in the range 100-2000 feet.

Preferably said predetermined legibility distance is in the range 100-10000 feet.

Preferably said predetermined legibility distance is in the range 30000-40000 feet.

Preferably said predetermined legibility distance is defined by and lies within the volume of a cone of legibility.

Preferably said built structure is a roof.

Preferably said built structure is a pontoon.

In yet a further broad form of the invention there is provided a method of deriving revenue from advertising space, the method comprising the steps of: procuring an upward facing surface and obtaining signage rights to the surface; offering to a third party the surface as a platform for advertising indicia for a predetermined period of time; procuring the application of the advertising indicia to said surface in such manner as to be observable from craft passing over said surface at a predetermined legibility distance.

Preferably said revenue is directly linked to the benefit derived by said third party from the visibility and discernability of said indicia to viewers in said craft as it passes over said surface at said predetermined legibility distance.

In yet a further broad form of the invention there is provided a surface to which the above method is applied.

DETAILED DESCRIPTION OF THE PREFERRED EMBODIMENT

Embodiments of the invention will now be described in detail with reference to the accompanying drawings.

Figure 1:
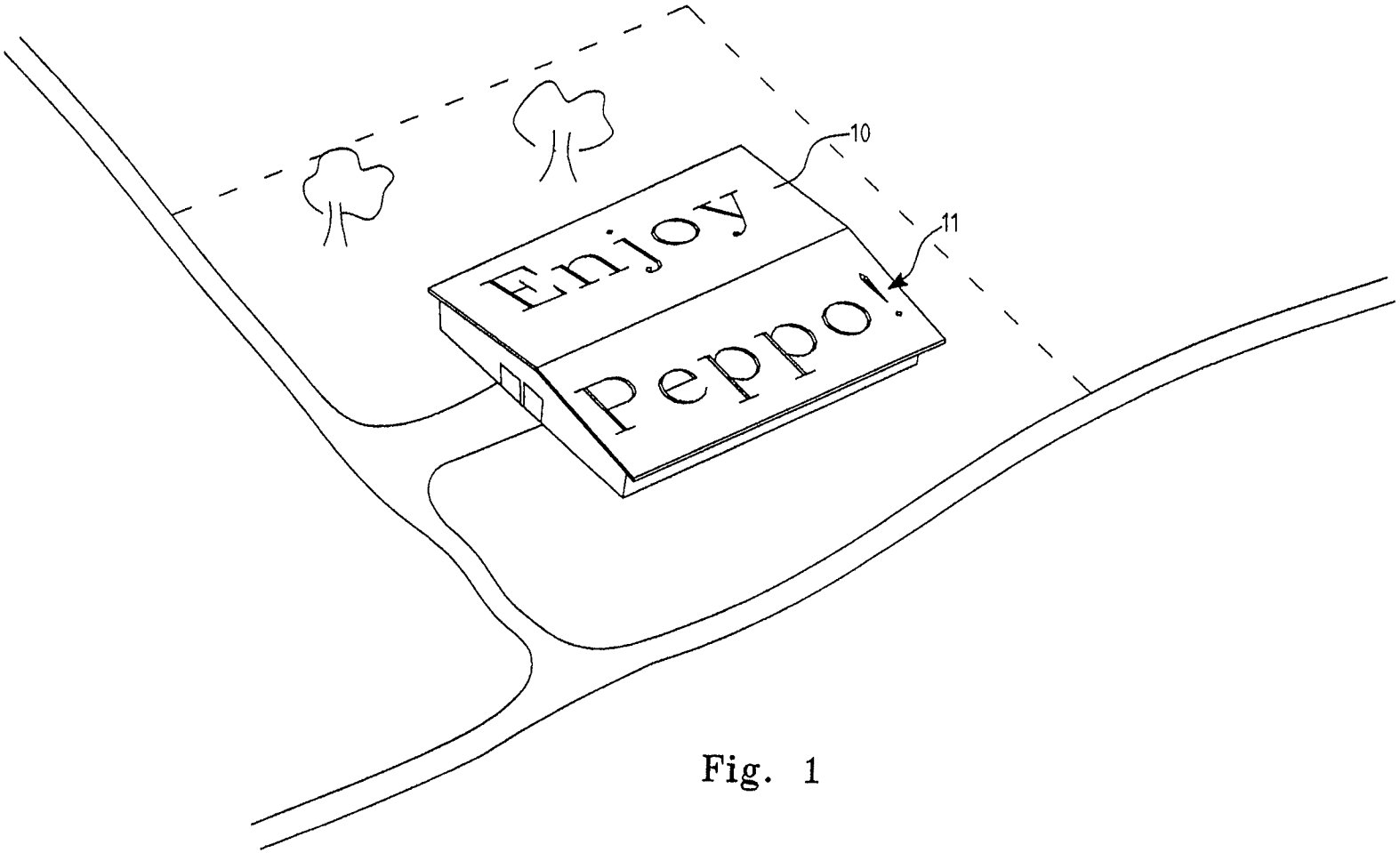
FIG. 1 is an illustration of a roof top displaying an image as it may be seen from an aircraft in accordance with a first preferred embodiment of the present invention.
Figure 2:
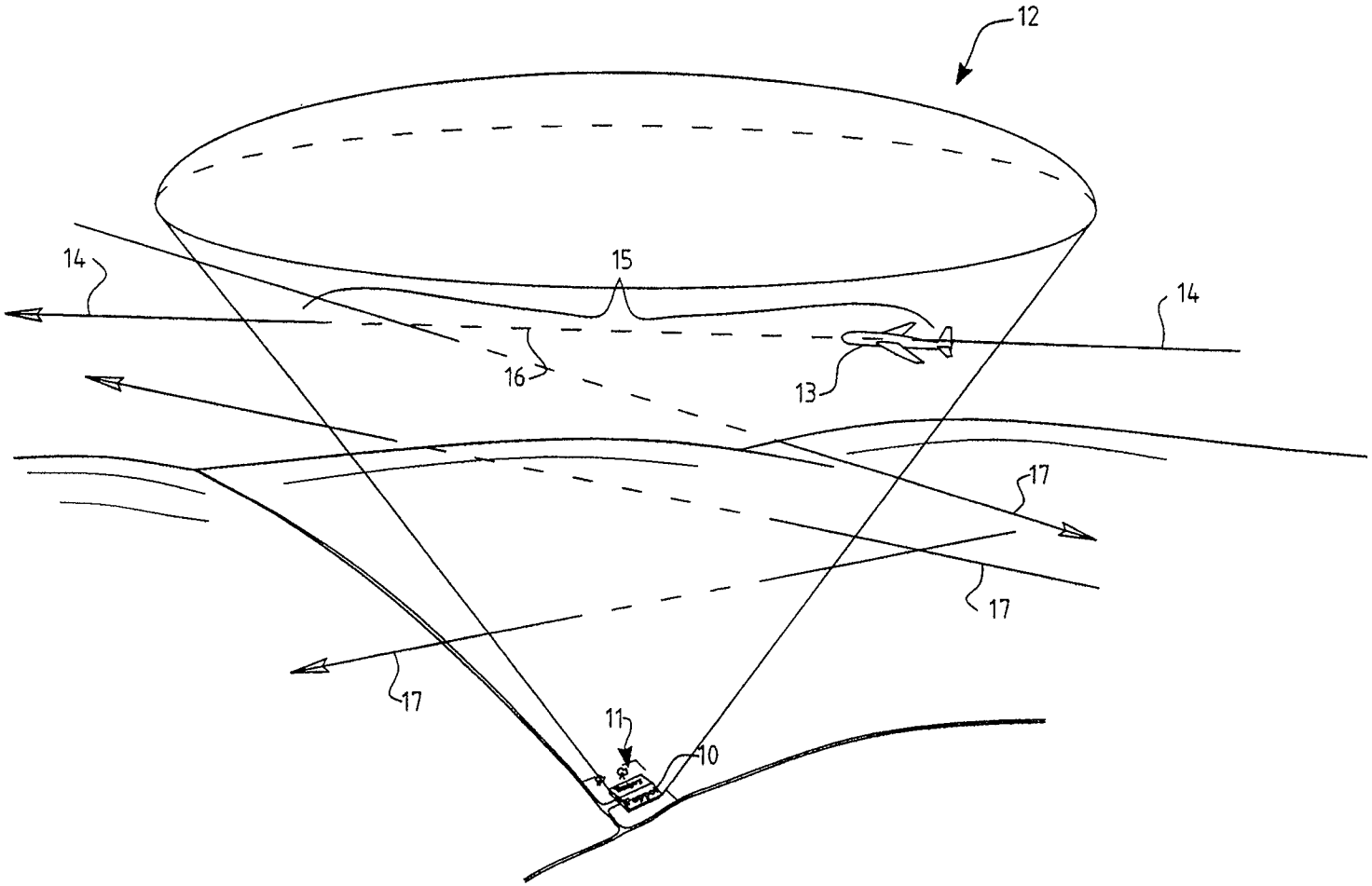
FIG. 2 shows a cone of visibility relative to the roof and image of FIG. 1.

In FIG. 1 a roof 10 has an image 11 applied to it. Roof 10 is oriented such that its surface is readily visible from an aircraft 13 flying a path through a "cone of legibility" 12 as shown in FIG. 2.

The cone of legibility 12 is a function of the smallest discrete detail which is considered useful to the impact and intelligibility of the image 11. The dimension of the cone 12 is then determined by the distance at which the unaided human eye can resolve that detail.

In one form, cone 12 is an inverted conical section of a sphere whose generator is equal to the distance of resolution of the smallest discrete detail of the image 11. The subtended angle of the cone 12 is also determined by the minimum inclination at which the image 11 can be resolved. The determination of the angle may include a parameter based on the nature of the roof 10 surface and discontinuities of that surface.

The apex of the cone 12 is centered on the image. FIG. 2 shows a cone of legibility 12 relative to roof 10 and image 11 with an aircraft 13 on flight path 14 intersecting the cone 12 for a distance 15 as shown by dashed line 16. Also in FIG. 2 are shown other flight paths 17 which are known to pass through the cone.

The size of the cone of legibility 12, the number of flight paths, number and types of aircraft passing through the cone 12 as well as the duration of each such passage, are contributing factors to the commercial value of the image 11.

In use, the commercial value of a roof 10 space and a proposed image 11 may be calculated from the cone of legibility 12, local flight paths intersecting the cone 12, flight frequencies and durations, types of aircraft and other relevant data.

Figure 3:
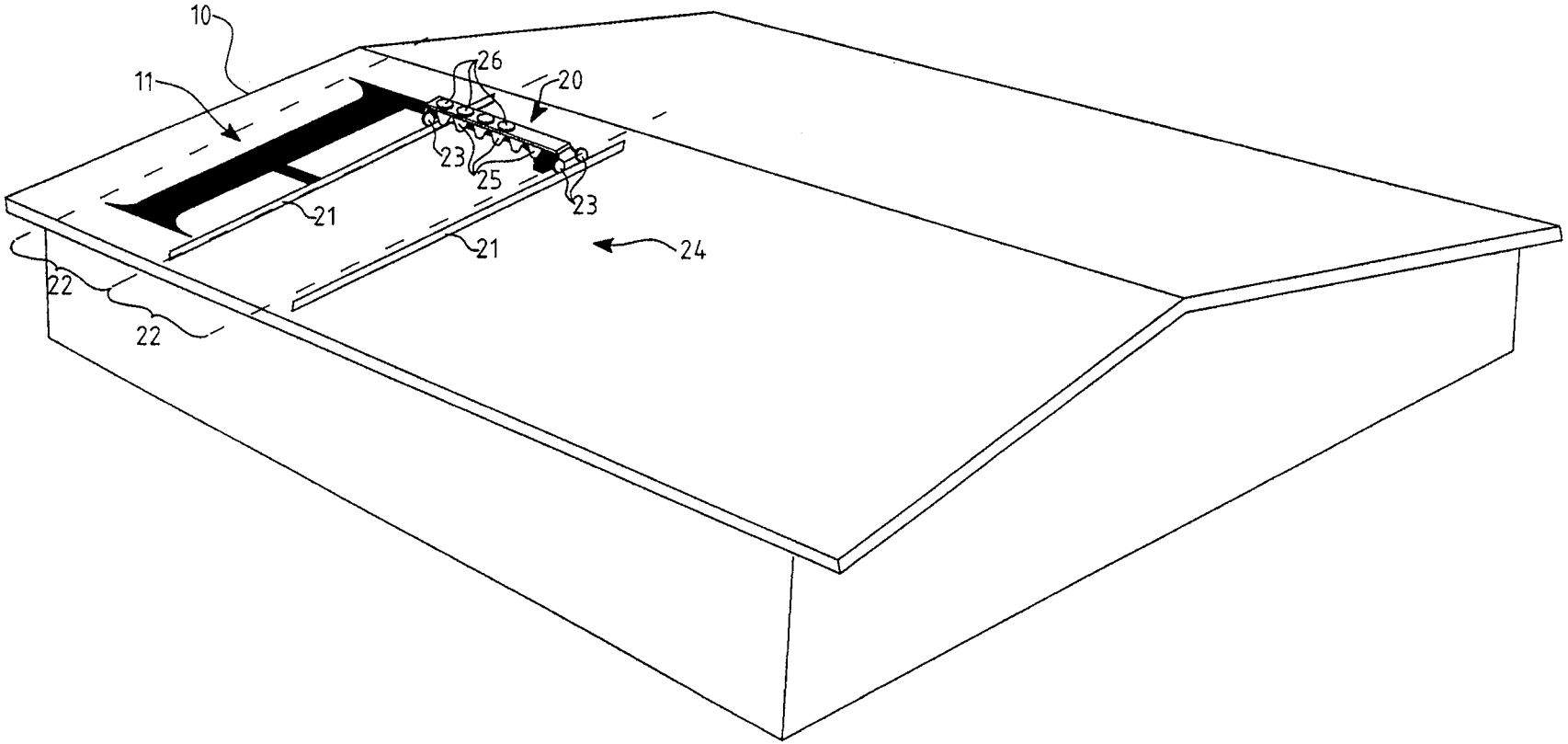
FIG. 3 is a perspective view of an image applicator traversing a roof section for the creation of an image of the type shown in FIG. 1.

FIG. 3 illustrates the general principle according to which an image 11 may be applied to a roof surface 10. An applicator 20 is arranged to follow a parallel rail system 21. Rail system 21 is relocated to allow respective bands 22 of image 11 to be applied.

In a preferred embodiment applicator 20 is in the form of a beam structure straddling the guide rails 21 comprising rail system 24 and provided with support wheels 23 and drive means to propel the applicator 20 along the guide rails 21. The beam structure is provided with a plurality of nozzles 25, paint reservoirs 26 and control means to direct paint to selected nozzles 25 according to a control program based on the digitized image 11 to be applied.

In a further preferred embodiment the applicator 20 is of modular construction to allow it to be lifted to the roof 10 in sections. Its modular construction is further adapted to allow multiples of beam segments to be joined together to provide various lengths of beam to suit different roof 10 and image 11 sizes.

Figure 4:
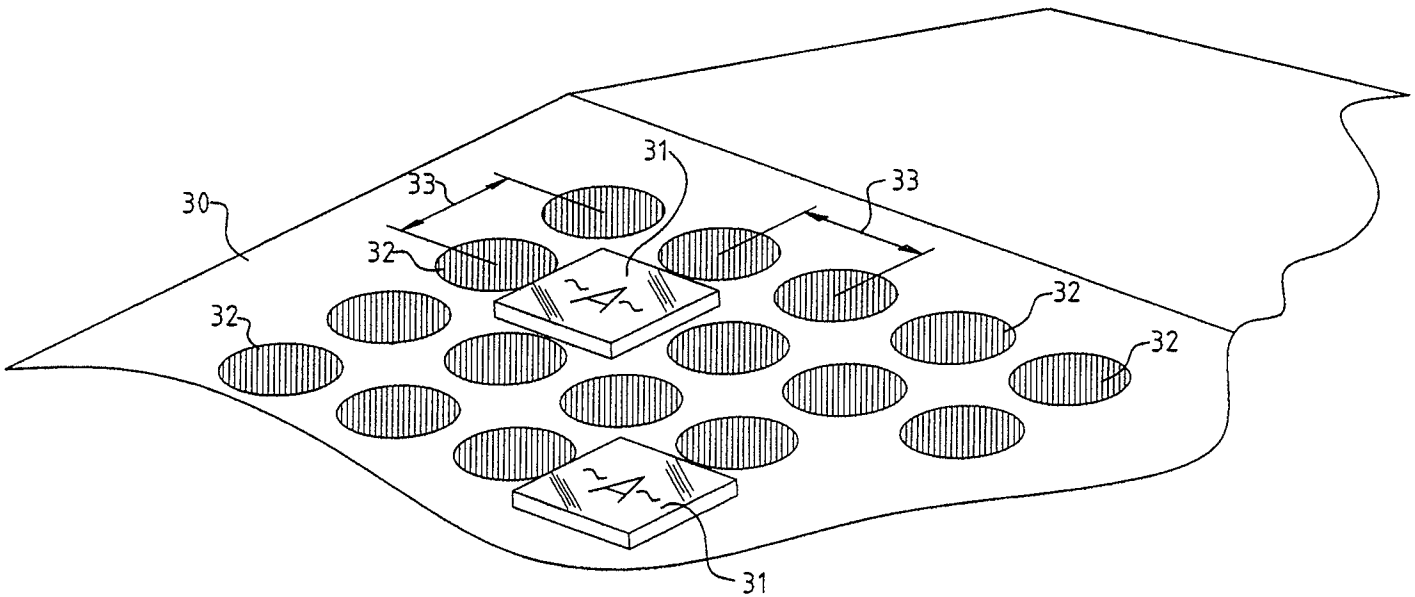
FIG. 4 is an illustration of a relationship between the effective areas of pixels and interpixel spacing as used to form an image of the type shown in FIG. 1.

In a further preferred embodiment the image 11 is made up of pixels. The pixel size and interpixel spacing are determined according to the principles of information theory and are functions of the roof 10 size and image 11 detail as well as discontinuities in the roof 10 surface. By way of a non limiting example, FIG. 4 illustrates some of these relationships where a roof surface 30 has discontinuities in the form of skylights 31 of surface area "A". Pixels 32 are then selected as having surface area A/2 with interpixel spacing 33 a percentage of pixel diameter "D".

In use, the image 11 to be applied is digitized and segmented into parallel bands 22, if required, for an applicator 20 to cover the surface area of the image 11. By means of software, the digitized image is translated into a control program for the dispensing of different coloured paints from the applicator nozzles as it traverses a roof section.

Also in use in commercial applications a typical commercial implementation involves the steps of:

Procuring a roof surface and obtaining signage rights to the roof surface;

Offering the roof surface as a platform for advertising indicia for a predetermined period of time;

Procuring the application of the advertising indicia in such manner as to be observable from over flying aircraft.

The above describes only some embodiments of the present invention and modifications, obvious to those skilled in the art, can be made thereto without departing from the scope and spirit of the invention.

For example, it is to be understood that the image 11 to be applied to the rooftop can be applied in many ways other than by direct physical application. For example, the image 11 may be applied indirectly as a separate layer overlaid upon the rooftop. In alternative forms the image 11 may be applied indirectly by, for example, the projection of light onto the rooftop.

In yet other forms the image 11 may be applied as an "active" image, which is to say in the form of a light emitting system such as can be provided by an array of lights, a CRT panel or the like.

Furthermore, analogous built structures may act effectively as rooftops for the purpose of forming a base for advertising display of the kind envisaged in this specification.

Specific examples of implementations of procedures compatible with one or more of the described embodiments will now be provided in detail:

Example 1

Method of Deriving Revenue

Figure 5:
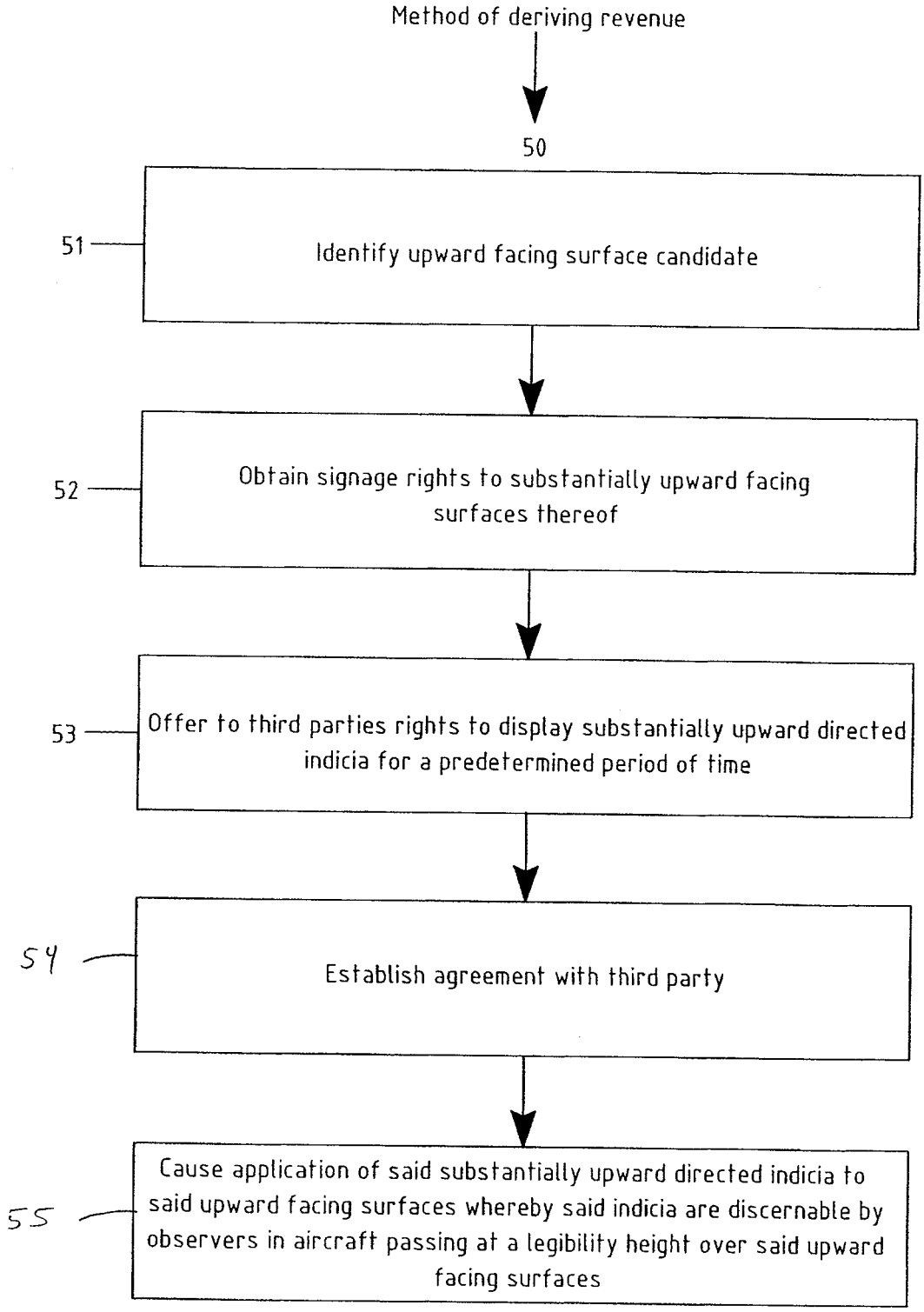
FIG. 5 is a flow chart of an exemplary leasing/renting procedure for use in accordance with a particular example of embodiments of the present invention.

With reference to FIG. 5 a basic renting/leasing procedure is demonstrated in block diagram form.

In this arrangement the steps in a method 50 of deriving revenue from an upward facing surface are put into effect by the following steps:

In a first step 51 an upward facing surface is identified as a potential candidate to receive indicia thereon for viewing at a legibility distance by observers in an overflying craft. In typical instances this upward facing surface may be located near an airport but can be located elsewhere subject only to satisfying the basic requirement that the surface can be viewed by overflying craft and that indicia can be applied in a way such that they are made visible and discernable to observers in the craft looking down upon the upward facing surface and, more particularly, the indicia thereon.

In second step 52 signage rights are negotiated to the upward facing surface. In some instances it may be that the surface is, for example, a rooftop surface which already has a substantially vertically disposed sign thereon adapted for viewing from ground level. Any rights third parties may have to the substantially vertically disposed signage can be thought of as completely independent from rights to be negotiated for the substantially upward facing surfaces upon which, indeed, the substantially vertical sign may sit. It is conceivable in some instances that the substantially vertically oriented sign may remain and not interfere with indicia placed on the upward facing surfaces and for which separate signage rights may be negotiated in accordance with step 52.

Having negotiated signage rights both rights can be offered to third parties in a third step 53, usually for a predetermined period of time.

Once these basic steps have been performed agreement with the third party can be formalized in a step 54 and then given effect by causing the application of substantially upwardly directed indicia to the upward facing surfaces whereby the indicia are discernable by observers in craft passing over the upward facing surfaces at a legibility height in a step 55.

Example 2

Value to an Advertiser

Figure 6:
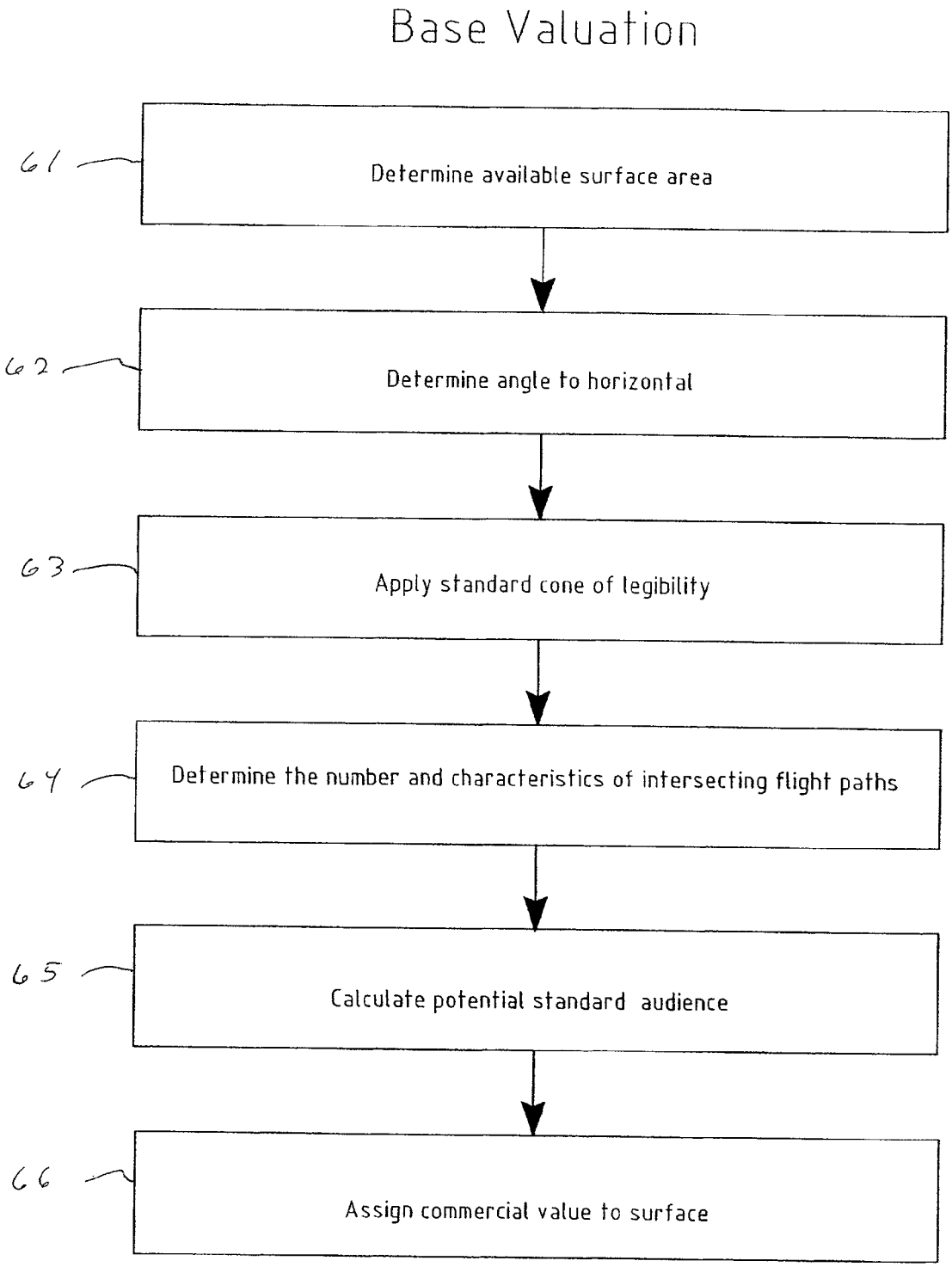
FIG. 6 is a flow chart of a valuation method in accordance with an example of embodiments of the present invention.

With reference to FIG. 6 a surface available for advertising purposes has a surface area $Am^2$ (block 61) and is angled at $\alpha°$ to the horizontal (block 62). A potential client wishes to display a certain logo in the form of a text string which, to fit in the available area, demands that the letters of the logo have a maximum height of x metres.

Several factors then need to be taken into account in determining the maximum resolution distance and maximum angle of inclination to the roof surface at which the logo can be resolved by the naked eye including:

(a) the maximum text height, (b) the colours of the logo text and background to give a contrast factor, (c) the texture and any discontinuities of the roof surface or the texture of sheeting or other media (if the logo is not to be applied directly to the existing roof surface).

These parameters of distance and angle may be determined empirically by reference for example to suitable computer modeling of the logo and roof surface area with scaling and spatial rotation of the image to simulate its appearance and legibility at various viewing distance and angles.

With these parameters established the cone of legibility is defined (block 63) and any intersecting flight paths, their frequencies and passenger densities may be determined (block 64). The value then of the roof space for advertising purposes can be calculated on the basis of the number of potential viewers over a given period (blocks 65 and 66).

Not all potential viewers need be valued equally however; for example a large passenger jet passing through the cone on a descent towards landing at an average height of 500 ft will have greater value than a similar jet passing through the cone at for example 5,000 ft even if the passengers of both jets would be able to resolve the logo.

Furthermore, the cone of legibility may contain flight paths which are curved and during the transit of which an aircraft is banked so as to afford the maximum viewing potential of the rooftop to at least half of its passengers.

Thus scaling factors may be introduced which take account of the actual average distance from the roof and the benefits of any curvature of a flight path as inputs into the calculations of the value of an advertising space.

In this example the valuation is performed for the benefit of the potential advertiser in that an assessment may now be made as to whether the cost of leasing the space is warranted in view of the potential audience which may view the advertiser's logo over the period of the lease.

Example 3

Value to a Leasing Agent and Surface Owner

Figure 7:
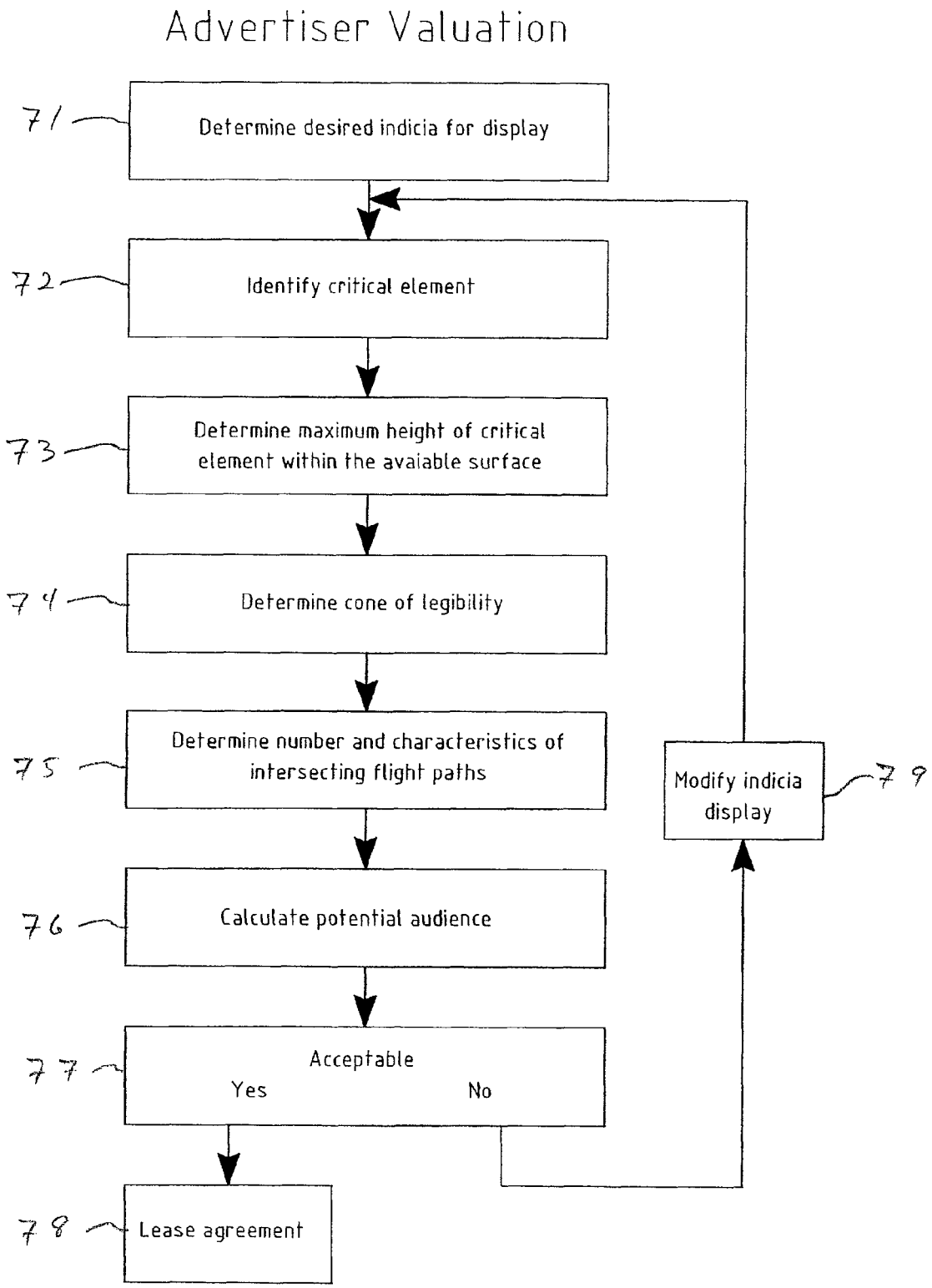
FIG. 7 is a flow chart of an advertiser valuation method in accordance with a further example of embodiments of the present invention.

With reference to FIG. 7 clearly, the larger the indicia applied to a given surface the larger will be the cone of legibility and the potential viewing audience, other factors being equal. Therefore the method performed in Example 1 may not confer an adequate value on the surface area offered if the cone of legibility is relatively small because of small indicia specified by the advertiser.

For the purpose of assigning a base value to a given available surface area, a leasing agent may perform a similar operation as described in Example 1 but use a cone of legibility based on a standard indicia size applied to a standard surface. By applying this "standard cone" to the available surface, the potential viewing audience is ascertained from the number and characteristics of flight paths through the cone and so establish a market value for the surface.

In a block 71 the indicia desired for display are determined. In a block 72, one or more critical elements are determined, for example text or logos which the advertiser particularly wishes to be legible to the viewing audience. In a block 73, a maximum dimension of the one or more critical elements is determined within the available viewing surface. In a block 74, a respective cone of legibility 12 is determined. In a block 75, the number and characteristics of intersecting flight paths 17 are determined for the cone of legibility from block 74. In a block 76, a potential audience is calculated from the determined number and characteristics of the intersecting flight paths from block 75.

In a block 77, the preceding calculations are evaluated and determination is made as to whether this results in a acceptable arrangement for the advertiser in a block 77. If the arrangement is acceptable, a lease agreement would typically be concluded in a block 78. If however the arrangement is not acceptable, a block 79, wherein characteristics of the indicia display is modified, typically to expand the cone of legibility 12.

Example 4

Floating Surface

Figure 8:
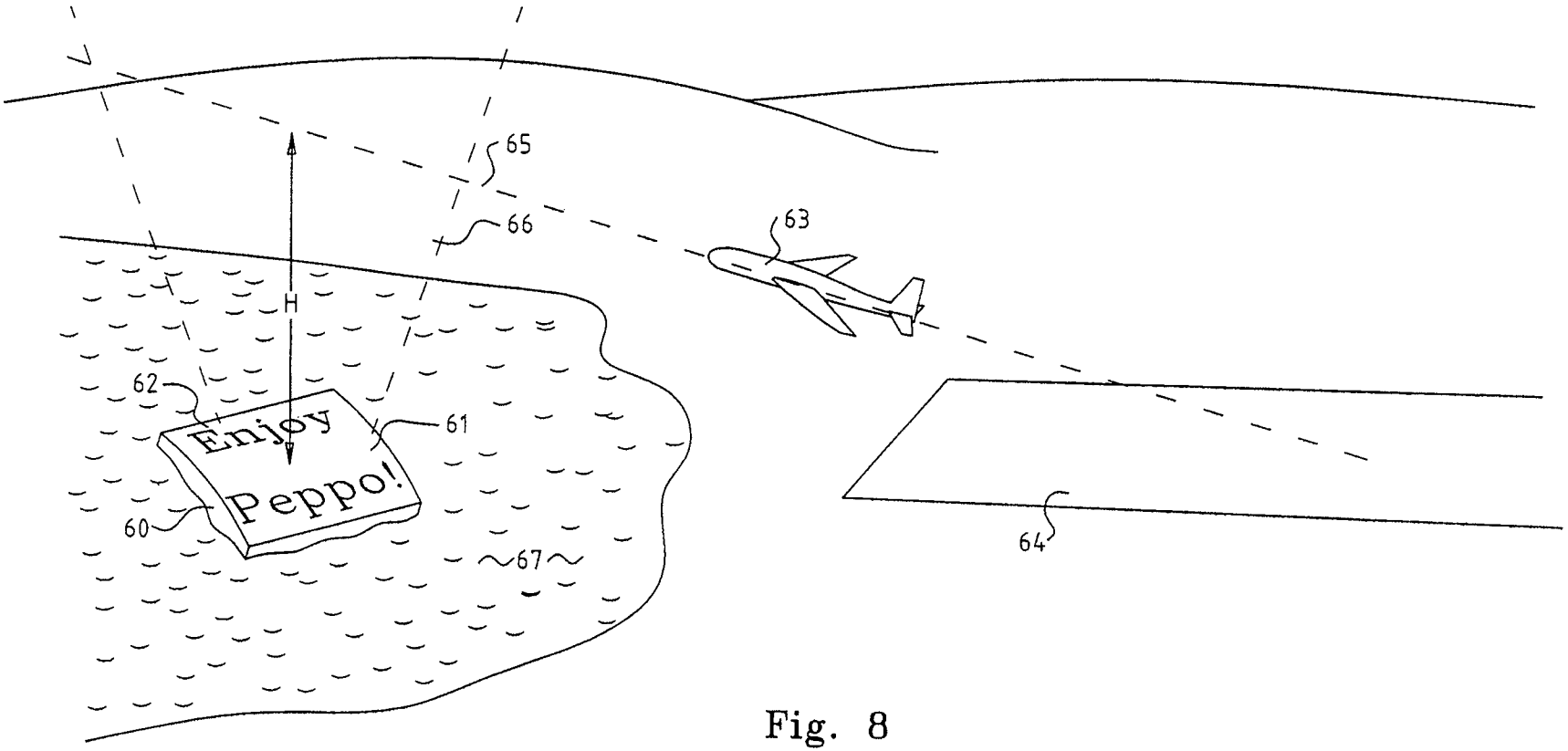
FIG. 8 illustrates an application of an example of the present invention to a floating pontoon in association with an adjacent airport facility.

With reference to FIG. 8, by way of an example intended to clarify the breadth of meaning to be given to the term "built structure" and "roof" in this specification there is illustrated a built structure 60 in the form of a pontoon or like floating structure having a substantially upwardly directed surface 61 upon which or into which indicia 62 can be inscribed and sized so as to be visible to observers in an overflying craft, in this instance aeroplane 63 during a take off or landing phase from runway 64 and following trajectory 65 which has associated with it a cone of legibility 66 associated with indicia 62 which permits the discernment of the indicia 62 by the passengers or other persons in aeroplane 63. This particular example can be used with airports which lie adjacent bodies of water 67 as shown in this example.

The predetermined legibility distance H inherent in the cone of legibility 66 associated with flight path 65 can, for example, lie in the range 100-2000 feet. In alternative arrangements the predetermined legibility distance can be in the range 100-10000 feet. In yet alternative arrangements the legibility distance H can be the typical cruising height range for an aircraft, typically in the range 30000-40000 feet.

Combined Vertical and Horizontal Sign Disposition

Figure 9:
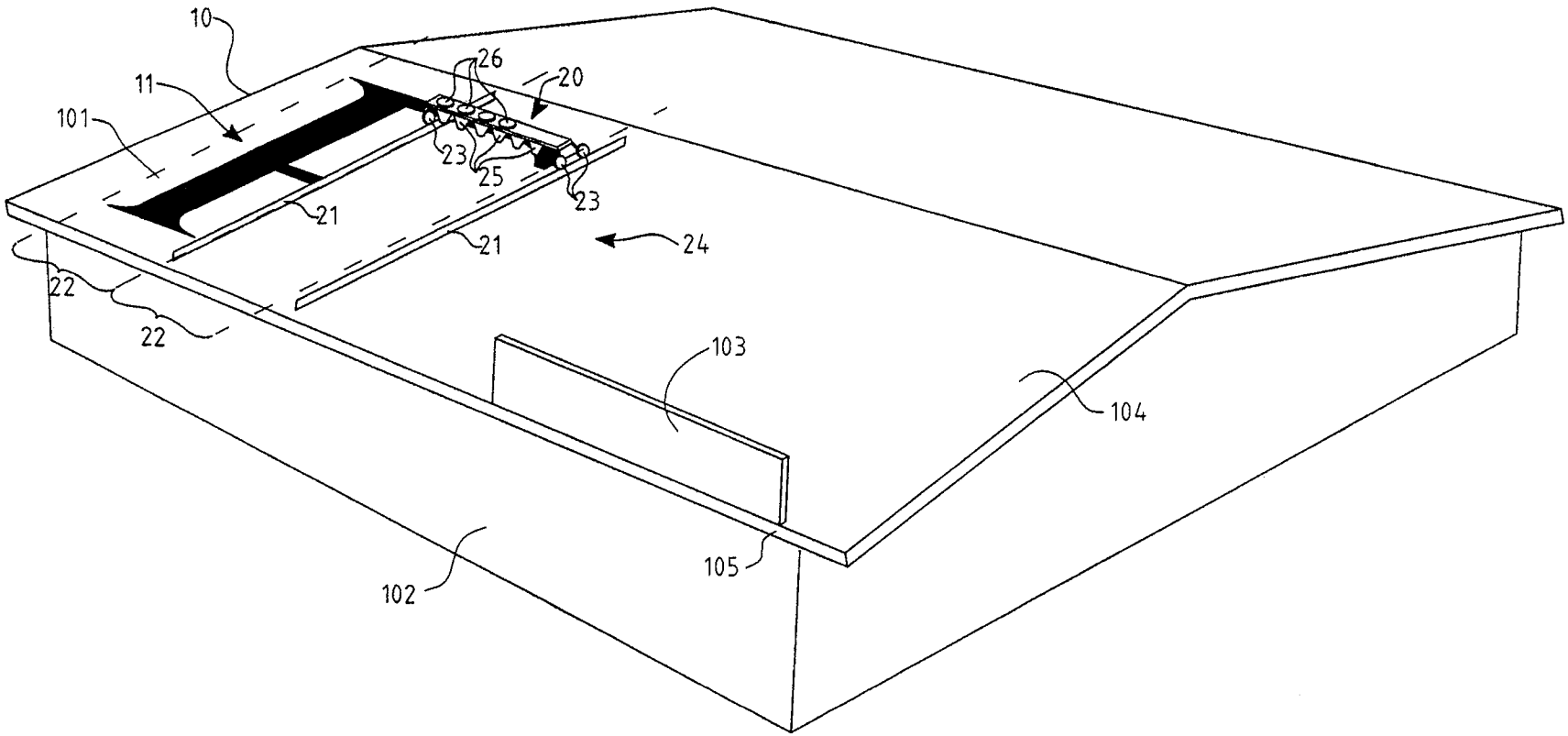
FIG. 9 illustrates a built structure having first and second images applied to it in accordance with a preferred embodiment for the invention.

By way of specific example FIG. 9 illustrates the use of a first substantially upward facing image 101 applied to a built structure 102 in conjunction with a second substantially horizontally facing image 103 also mechanically associated with the built structure 102 and, more particularly a facing surface 104 thereof. In this instance the second image 103 forms part of a sign structure mechanically connected to and projecting substantially upwardly from a portion 105 of upwardly facing surface 104.

Interposed Mechanical Sign Support

Figure 10:
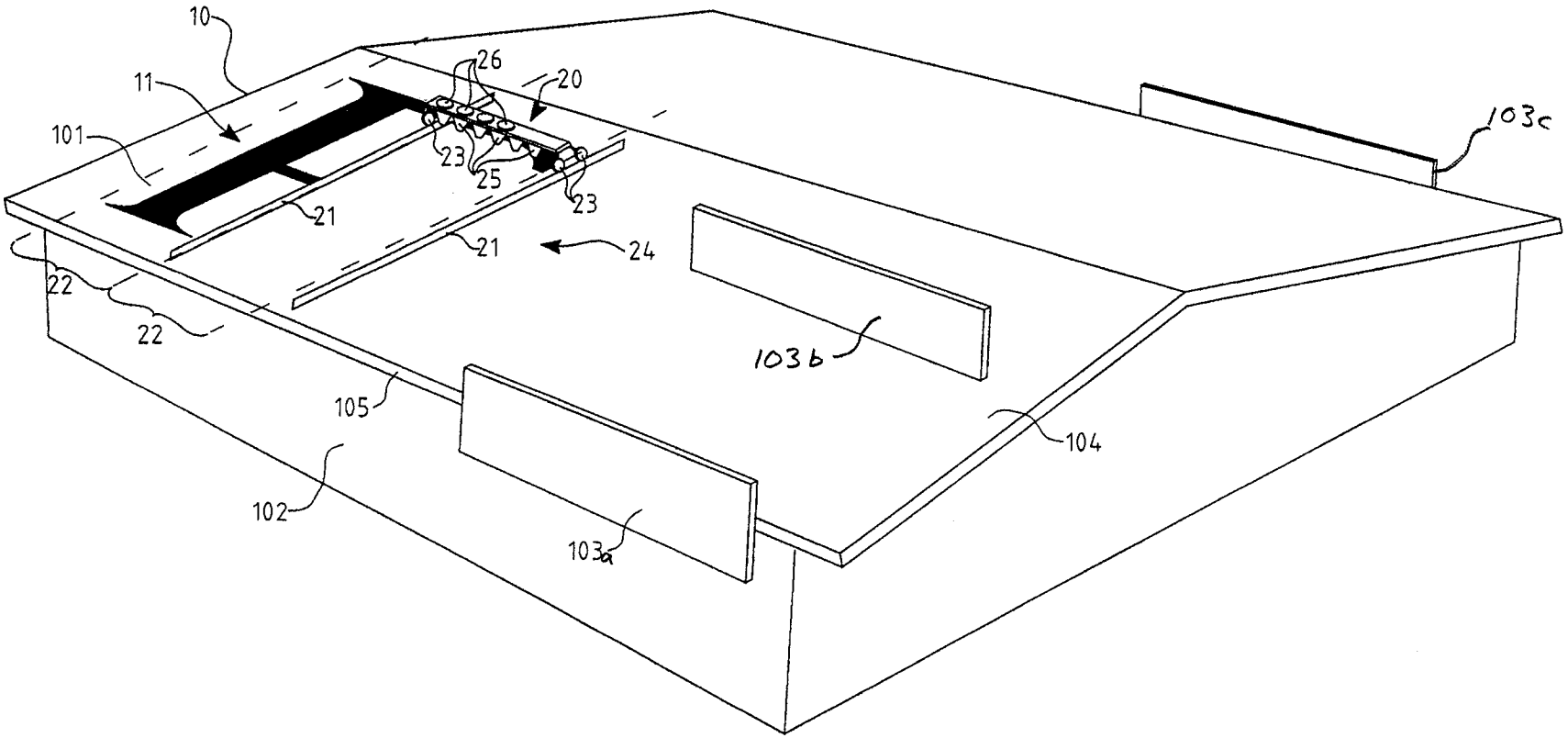
FIG. 10 is a diagram of a built structure having two images applied to it in accordance with a further embodiment for the present invention.

With reference to FIG. 10 a further embodiment of a multiple image arrangement is illustrated wherein like components are numbered as for FIG. 9. In this instance, a plurality second image 103 forms part of a signage structure which projects substantially vertically downwardly from a portion 105 of upwardly facing surface 104 and is mechanically anchored thereto. In one embodiment, multiple second images 103*a*, 103*b* and 103*c* are arranged for legibility from multiple different viewing perspectives.

The arrangement of FIGS. 9 and 10 permits increased utilization of upwardly facing surface 104 for signage purposes.

Figure 11:
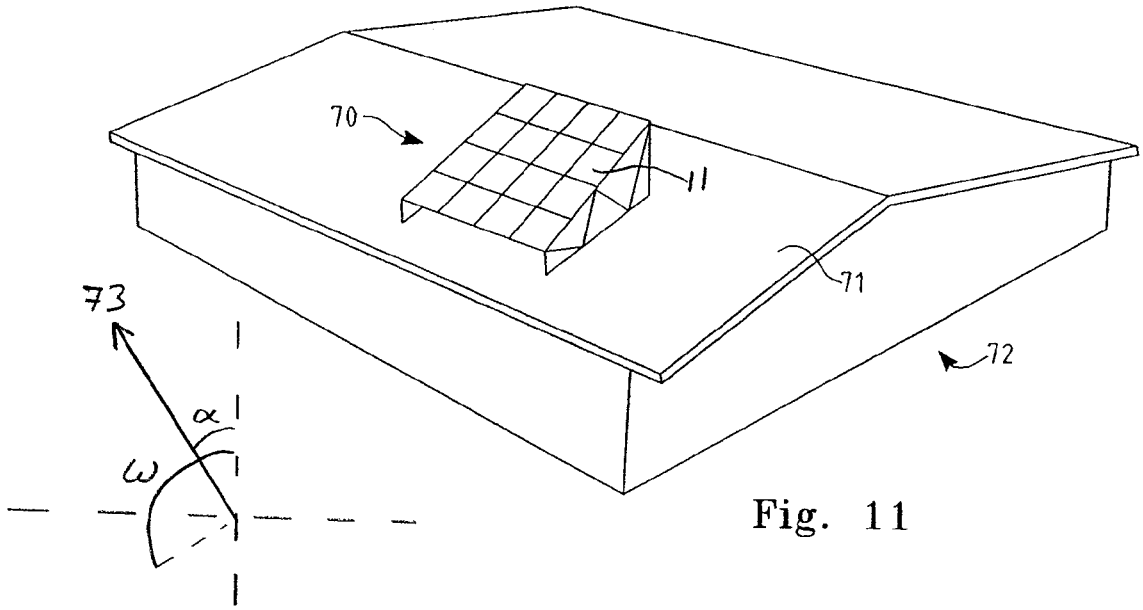
FIGS. 11 and 11*a* illustrate support structures to which images may be applied.
Figure 11A:
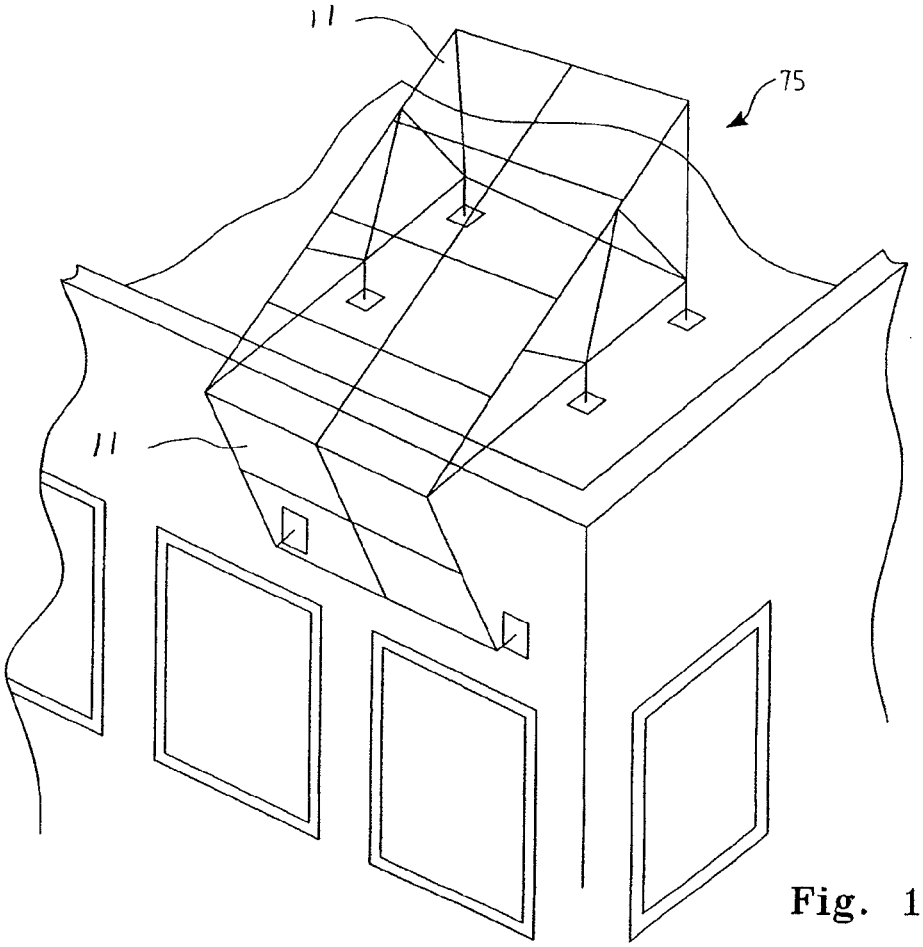

With reference to FIG. 11, signage may be applied to a permanent support structure or lattice 70 mounted to an upward facing surface 71 of a built structure 72. Such a lattice 70 allows the ready exchange of indicia 11 printed onto sheeting. In at least one preferred form of the invention, the same or related indicia 11 printed on sheet material, may be applied to a combined lattice structure 75 (as shown in FIG. 11*a*) exposing the indicia both to observers in over-flying aircraft or from a generally downward viewing perspective and observers at ground level or in nearby buildings or from a generally horizontal and/or upward viewing perspective.

Apart from offering a more convenient means of exchanging advertising indicia, a further advantage offered by a supporting lattice or support 70 is that the aspect or angular orientation of the support 70 may be tilted to optimize the visibility of the applied indicia independent of the slope of the upwardly facing surface of the built structure. Thus the axis 73 of a cone of legibility 12 may be inclined or oriented at any desired angle to maximize exposure of the indicia to a particular flight path or bundle of flight path situations.

Combined Vertical and Horizontal Sign Disposition

By way of specific example FIG. 9 illustrates the use of a first substantially upward facing image 101 applied to built structure 102 in conjunction with a second substantially horizontally facing image 103 also mechanically associated with built structure 102 and, more particularly the facing surface 104. In this instance the second image 103 forms part of a sign structure mechanically connected to and projecting substantially upwardly from each portion 105 of upwardly facing surface 104.

Interposed Mechanical Sign Support

With reference to FIG. 10 a further embodiment of a dual image arrangement is illustrated wherein like components are numbered as for FIG. 9. In this instance second image 103 forms part of a signage structure which projects substantially vertically downwardly from each portion 105 of upwardly facing surface 104 and is mechanically anchored thereto.

The arrangement of FIGS. 9 and 10 permits increased utilization of upwardly facing surface 104 for signage purposes.

With reference to FIG. 11, signage may be applied to a permanent support structure or lattice 70 mounted to an upward facing surface 71 of a built structure 72. Such a lattice allows the ready exchange of indicia printed onto sheeting (not shown). In at least one preferred form of the invention, the same or related indicia printed on sheet material, may be applied to a combined lattice structure 75 (as shown in FIG. 11*a*) exposing the indicia both to observers in over-flying aircraft and observers at ground level or in nearby buildings.

Apart from offering a more convenient means of exchanging advertising indicia, a further advantage offered by a supporting lattice or support is that the aspect of the support may be tilted to optimize the visibility of the applied indicia independent of the slope of the upwardly facing surface of the built structure. Thus the axis of a cone of legibility may be inclined at any desired angle to maximize exposure of the indicia to a particular flight path or bundle of flight path situations.

Sheeting to which indicia has been applied, for example by a suitable printing process, may be releasably fastened to the support lattice by any suitable fastener system, such as screws or nuts and bolts or by means of clamps incorporated in the lattices structure.

An alternative means of using the structure for display of interchangeable indicia may be provided by the indicia being applied to flexible sheeting wound onto a roller assembly in the manner of a Holland blind. One or more fixtures for support of one or more roller assemblies can be provided at an upper edge of the lattice structure thus allowing a rapid exchange of advertising indicia to be effected.

For example, a central axis 73 of a cone of legibility 12 can be oriented at an angle $\alpha$ from a vertical orientation. In certain embodiments, an inclination of the axis 73 of the cone of legibility 12 accommodates an inherent inclination of a surface 71 of a built structure 72. In other embodiments, an inclination of the axis 73 of the cone of legibility 12 by an angle $\alpha$ from vertical is adapted to provide improved viewing characteristics of the cone of legibility 12, for example to favor viewing of the cone of legibility 12 from a flight path 17 which may be horizontally offset from the built structure 72. It will be understood that in certain embodiments the inclination of the axis 73 by and angle $\alpha$ from vertical can lie in the range of 90-180° such that a viewer of the indicia 11 has a generally horizontal and/or upwardly directed viewing perspective. It will also be understood that in certain embodiments, the axis 73 of the cone of legibility 12 can be oriented by and angle $\Omega$ from a horizontal or lateral reference, for example true or magnetic north. In a similar manner to the possibility for vertical inclination of the axis 73 by an angle $\alpha$, a horizontal or azimuth orientation of the axis 73 by an angle $\Omega$ can accommodate an inherent orientation of a built structure 72 and/or be adapted for advantageous presentation of the cone of legibility 12.

Sheeting to which indicia 11 has been applied, for example by a suitable printing process, may be releasably fastened to the support lattice 70 by any suitable fastener system, such as screws or nuts and bolts or by means of clamps incorporated in the lattice structure 70.

An alternative means of using the structure 70 for display of interchangeable indicia 11 may be provided by the indicia 11 being applied to flexible sheeting wound onto a roller assembly in the manner of a Holland blind. One or more fixtures for support of one or more roller assemblies can be provided at an upper edge of the lattice structure 70 thus allowing a rapid exchange of advertising indicia 11 to be effected.

Computer Platform Implementation

Figure 12:
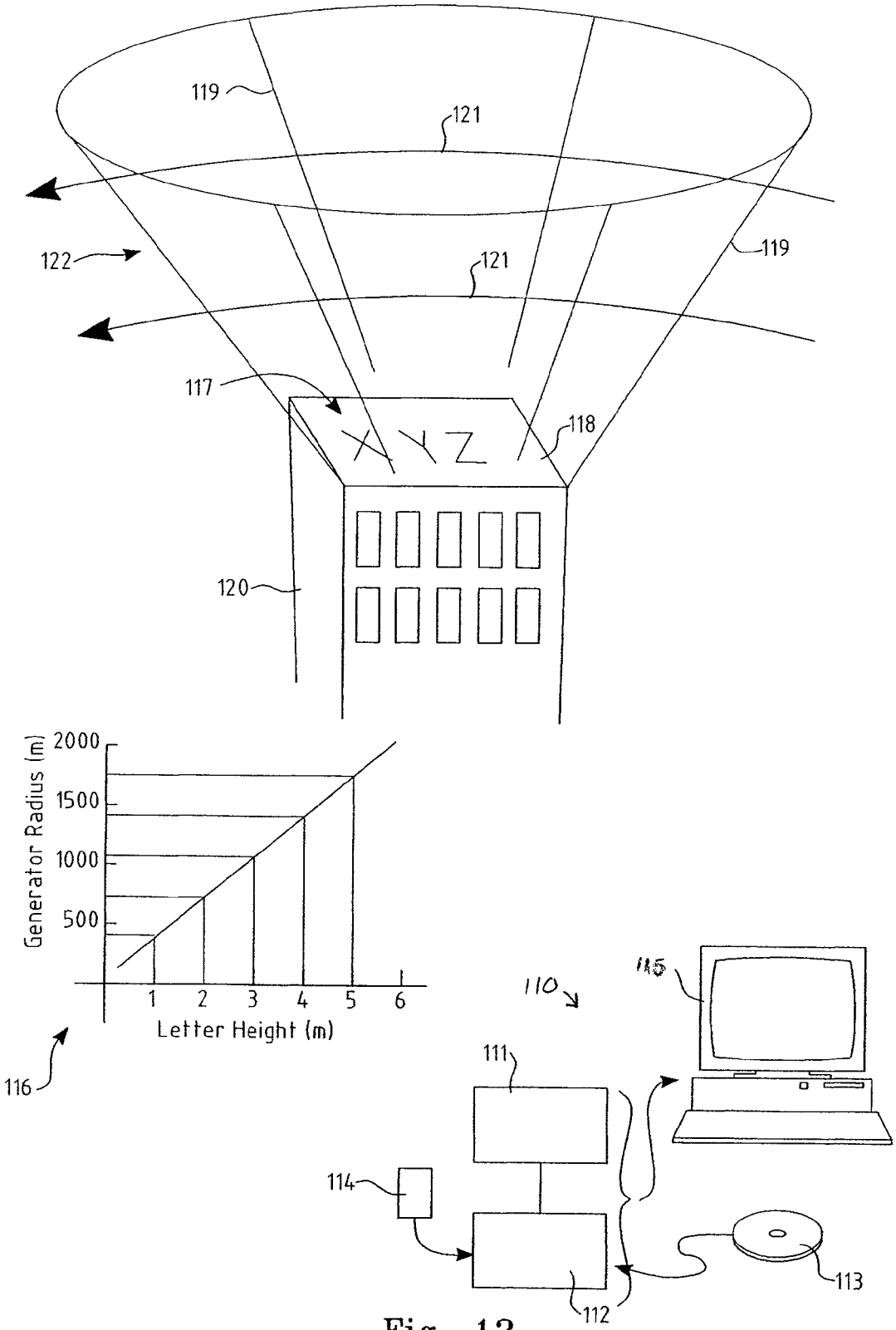
FIG. 12 illustrates diagrammatically embodiments of the invention implemented on a computer platform.

With reference to FIG. 12 the methods of utilisation of a substantially upwardly facing surface as described earlier in this specification may be implemented on a computer platform 110. In this instance the platform 110 includes microprocessor 111 in communication with memory 112 and in communication with removable media 113. In use a programme 114 is loaded into memory 112 for execution on microprocessor 111 and subsequent display of results on display 115. The programme 114 includes reference data including a lookup table which can be represented graphically as Graph 116 whereby there is an association between letter or indicia height for upwardly facing indicia 117 on upwardly facing surface 118 and the length or radius of generator 119.

In addition for any given built structure 120 flight path information as previously described may be input either by media 113 or by other means such as download from the Internet whereby all flight paths 121 which pass through a cone of legibility 122 are available to the programme 114.

A difficulty in evaluating a roof or other upwardly directed surface for the purpose of displaying advertising indicia, is the quantifying of the exposure of the indicia to observers or potential consumers of the goods or services being advertised. The invention provides a method whereby computer modelling is used in the evaluation of such advertising spaces.

The quantification requires the determination of a region, or three dimensional volume of space, centred on the indicia, within which an observer may sufficiently resolve the indicia so as to understand its content. This region comprises what may be called a cone of legibility.

For the purposes of this specification, a cone of legibility is a conical section of a sphere centred on the surface to be evaluated and with the axis of the cone normal to that surface. Such a notional cone may be said to be inherent to any set of indicia but without defining the limits of the cone, the number and characteristics of the potential observers cannot be determined.

The limits of legibility of the indicia, and hence the parameters of a cone of legibility, will depend on a number of factors, among which may be enumerated the texture and any discontinuities of the surface, characteristics of the indicia, a minimum angle to the surface, and maximum distance from the surface.

The combination of minimum angle and maximum distance at that angle, defines the generator of the cone of legibility. With these parameters established, the number of observers potentially exposed to the indicia may be derived from an analysis of the flight paths and characteristics of the craft passing through the cone.

A first phase, according to the invention, in evaluating the proposed surface, is determining the parameters of the cone of legibility and makes use of computer modelling of the above factors. With suitable graphic software, the proposed indicia are applied to a three dimensional, to-scale, computer model of the surface, making the indicia as large as the extent of the surface will permit. The model may incorporate as many of the detailed characteristics of the surface as the software permits including surface texture and discontinuities such as skylights, vents and so forth.

In this step the size of the discrete components of the indicia, such as that of individual letters or image details is determined. Where the surface under consideration may be affected by other nearby and higher structures, these should also be added to the three dimensional model.

The computer model may then be rotated in three dimensional model space and reduced in scale (by "zooming out") to simulate the appearance of the surface at increasing distances and angles. By this means the parameters of distance and minimum angle of the cone of legibility generator may be determined empirically and a representation of the cone superimposed on the model.

In a further step, the model is augmented by placing the surface and associated cone of legibility in correct orientation relative the horizontal plane, and in the correct geographical relationship with any nearby airport or flight corridor. Actual average flight paths as published on aeronautical charts are then added to the model and coded for frequency and type of aircraft.

Appropriate solid modelling software is able to compute length of the flight paths intersecting the cone and hence the duration of the passage of an aircraft along these modelled flight paths, given the typical ground speeds for the aircraft concerned. Duration, frequency and type of aircraft can provide an initial estimation of the number of observers which may be potentially exposed to the advertising indicia of the surface.

Clearly, the modelling may be refined in a number of ways to give more accurate estimations of the number of observers. For example, the actual angle of an aircraft's flight path subtended at the roof surface will affect the ease of viewing of observers on the aircraft. Ease of viewing will be minimal if the angle is 90 degrees or near 90 degrees; that is if the flight path is normal to the surface, with ease of viewing tending to optimum as the angle decreases. As well, only those passengers at window seats along that side of the plane facing towards the surface are likely to be observers.

Automated Signage System

Figure 13:
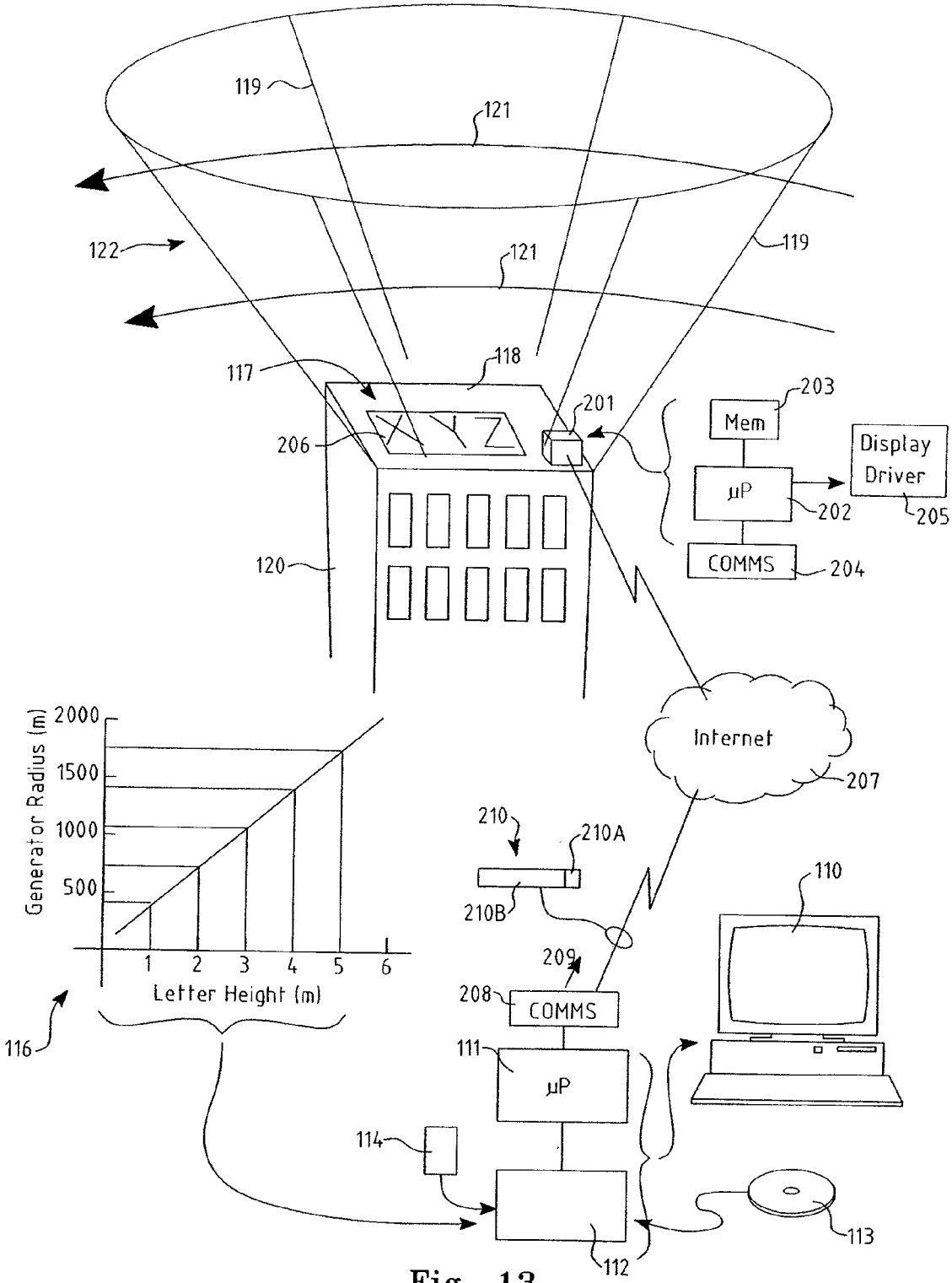
FIG. 13 illustrates diagrammatically an automated signage system in accordance with a further embodiment of the present invention.

With reference to FIGS. 13 through to 17 the various embodiments previously referred to in this specification can be brought together to form an automated signage system 200 as shown in generalised form in FIG. 13. In the embodiments illustrated in FIGS. 13 through to 17 like components are numbered as for previous embodiments.

In this instance the upwardly facing indicia 117 will be in the form of an "active" image as defined earlier in this specification. Being in this form it is possible to arrange the active image to be controlled electronically so as to be varied by local controller 201. Local controller 201 incorporates a processor 202 in communication with a local memory 203. The controller 201 is further adapted to communicate with a remote computer or like device by way of communications module 204 which is also in communication with global processor 202. In use processor 202 loads a predetermined active image to display driver 205 which, in turn, causes the active image 206 to be loaded for viewing as upwardly facing indicia 117.

In one embodiment memory 203 is loaded with more than one active image 206, each image having previously been determined and its commercial value evaluated in accordance with previously described embodiments. Selected ones of the active images 206 are then displayed in accordance with a particular revenue function and as agreed with the respective entity which desires the display of the predetermined active image 206.

For example, in one embodiment, a first image 206 is loaded to display driver 205 for display for a first period of time followed by the loading of a second active image 206 into display driver 205 for a second period of time following the expiry of which the first image is loaded once more and so on in cyclic fashion.

In a further embodiment memory 203 can be loaded with active images 206 from a remote computer for example via communication enabled via the Internet 207. In one particular instance a computer platform 110 can be utilised as the remote computer incorporating processor 111 and memory 112. In this instance processor 111 communicates active image data corresponding to a active image 206 via remote communications module 208 which communicates via Internet 207 with local communications module 204 of local controller 201. In one embodiment the active image data 209 is transmitted in blocks 210 of digital data, each block comprising a header 210A and a data portion 210B wherein, for example, the header 210A includes Internet Provider address information of the type recognised by the TCP/IP protocol as currently used for a major portion of Internet digital traffic.

As will be described in the embodiments illustrated in FIGS. 14 to 17, the active image 206 may be represented as upwardly facing indicia 117 in the form of an electronically manipulable image which may itself comprise active light sources (such as the phosphors of a CRT panel) or may be of the type which requires a separate light source, to, in effect, be shone through it (as, for example, certain forms of LED panel technology). In this embodiment, the illumination component may only be necessary, or at least will render the image most effectively, in a darkened environment (for example at night).

Figure 14:
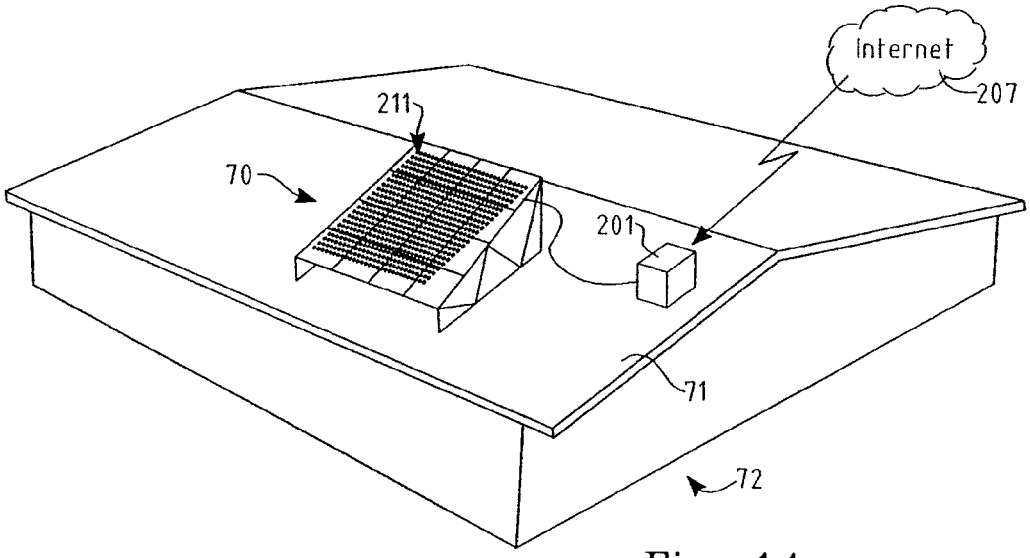
FIG. 14 illustrates a particular implementation of the system of FIG. 13.

With reference to FIG. 14 (where like components are numbered as for previous embodiments) the automated signage system 200 is implemented as an active LED matrix 211 mounted to support structure 70 which comprises an interposed mechanical support between the LED matrix 211 and upward facing surface 71. The LED matrix 211 is itself in electronic communication with local controller 201 thereby to be loaded with active image data in the manner previously described.

Figure 15:
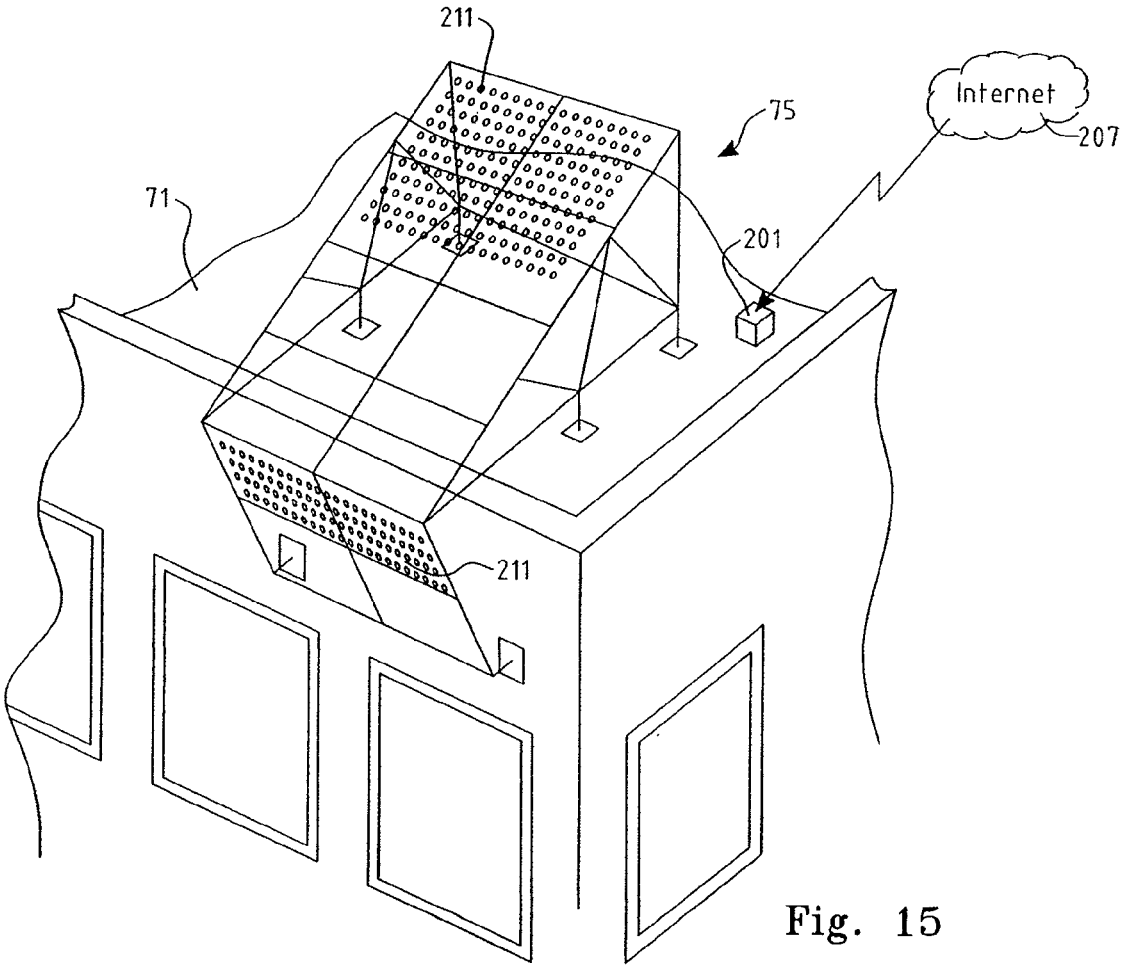
FIG. 15 illustrates an alternative particular implementation of the system of FIG. 13.

With reference to FIG. 15 the active LED matrix 211 is, in this instance, affixed to support structure 75 so as to function to provide both upwardly facing indicia and outwardly facing indicia, thereby to make dual use of the available upwardly facing surface.

Figure 16:
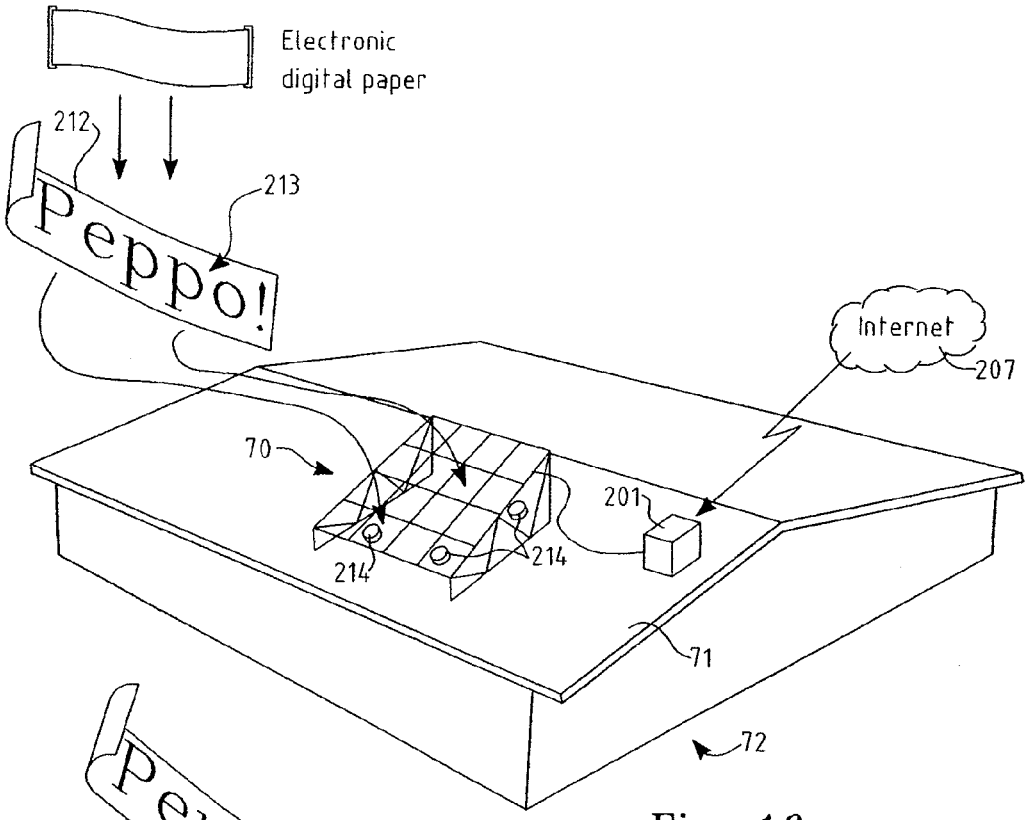
FIG. 16 illustrates an alternative particular implementation of the system of FIG. 13.

With reference to FIG. 16 an alternative form of implementation comprises application of a flexible sheet 212 of signage material to which indicia 213 has been applied. The flexible sheet overlays and is affixed to support structure 70 which, in turn, is affixed to the upwardly facing surface 71. One or more light source 214 can be placed within the support structure 70 and arranged so as to selectively shine through portions of the flexible sheet 212. The light source 214 is selectively controlled by local controller 201. A similar arrangement applies to the dual use arrangement shown in FIG. 17.

Figure 17:
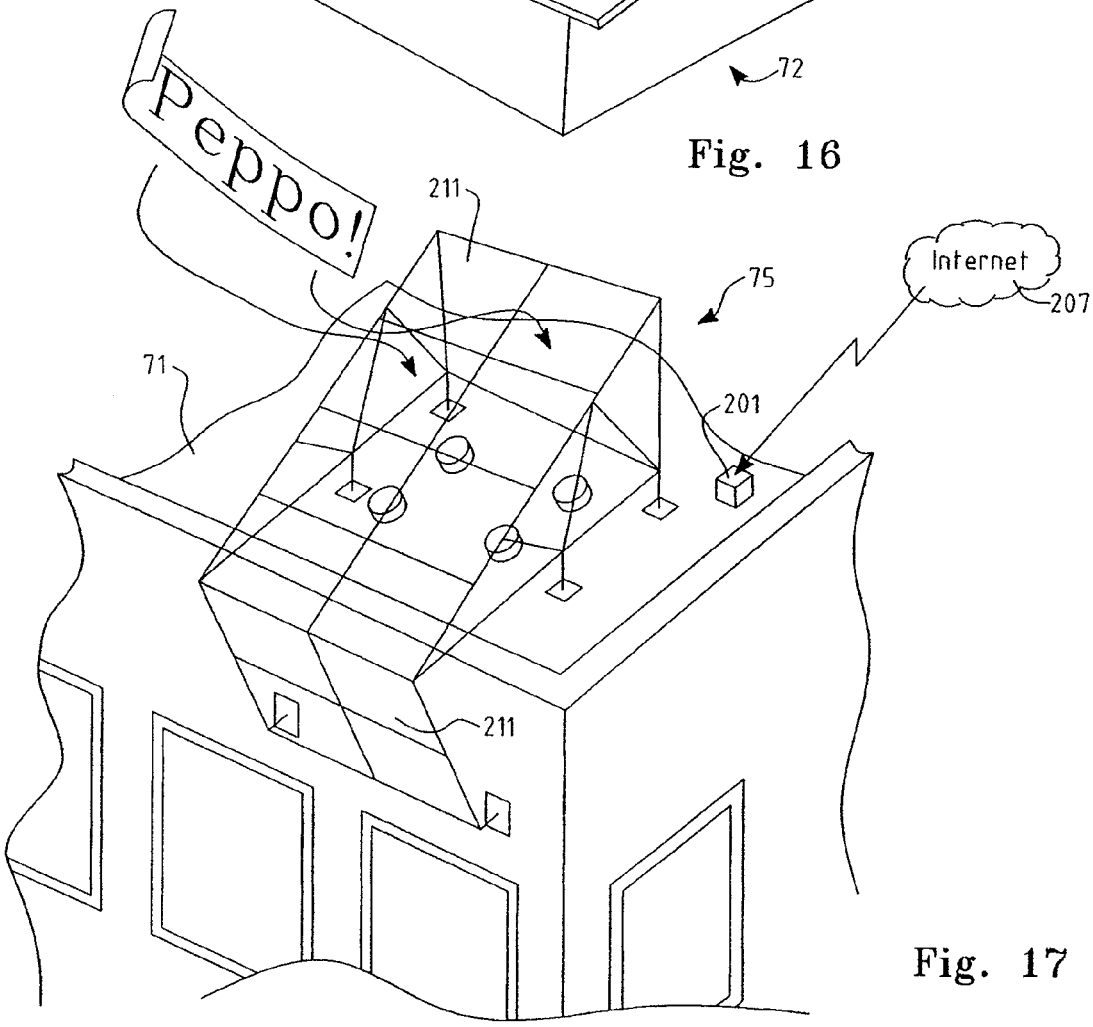
FIG. 17 illustrates an alternative particular implementation of the system of FIG. 13.

In a further particular form of FIGS. 16 and 17 the flexible sheet 212 comprises "flexible digital paper" as for example described in U.S. Patent Application US20020054033, the disclosure of which is incorporated herein by cross-reference. Alternative forms of the flexible digital paper comprise a laminate incorporating an image memory function. As previously described the electronic digital paper, once placed on the support structure 70, 75 is placed in electronic communication with local controller 201 thereby to allow loading of a predetermined active image in the manner previously described.

What is claimed is:

1. A system for the application of an image to an upper surface of a built structure, wherein the system comprises the image being arranged for visibility from craft; passing over said built structure and wherein said image comprises an active image formed on or in a surface of said upper surface; said image in communication with a local controller whereby said image can be replaced by loading a fresh image from a local controller; and where said local controller is in communication with a remote computer; said communication enabled by an internet; said remote computer adapted to communicate said active image to said local controller via the internet; and wherein said active image is transmitted via the internet in blocks of digital data; each block including a header and a data portion; said header including Internet Provider address information wherein the system commercializes by leasing of space on the upper surface of the built structure.

2. The system of claim 1 wherein said image is displayed for a predetermined time at a predetermined revenue rate.

3. The system of claim 1 wherein said image is in the form of a company name or logo.

4. The system of claim 1 wherein said image is displayed in the form of an advertisement for a product or service.

5. The system of claim 1 wherein said space on the upper surface of the built structure is made available on a commercial basis to third parties for the display of advertising indicia thereon.

6. The system of claim 1 wherein said image is displayed in the form of textual or graphic information.

7. The system of claim 1 wherein said image comprises a series of images displayed consecutively.

8. The system of claim 1 wherein said image is a moving image.

9. The system of claim 1 wherein each said image is formed from an array of coloured panels, segments, dots or pixels.

10. The system of claim 1 wherein each said image is provided with day and/or night time illumination.

* * * * *